US007340864B2

(12) United States Patent
Teramachi

(10) Patent No.: US 7,340,864 B2
(45) Date of Patent: Mar. 11, 2008

(54) ELASTIC SUPPORTER, ELASTIC SUPPORT UNIT AND SEISMIC SUPPORT UNIT USING SAME

(76) Inventor: Hiroshi Teramachi, 12-30-301 Kamiosaki 3-chome, Shinagawa-ku, Tokyo 141-0021 (JP)

( * ) Notice: Subject to any disclaimer, the term of this patent is extended or adjusted under 35 U.S.C. 154(b) by 528 days.

(21) Appl. No.: 10/739,387

(22) Filed: Dec. 18, 2003

(65) Prior Publication Data

US 2005/0055896 A1 Mar. 17, 2005

(30) Foreign Application Priority Data

Dec. 18, 2002 (JP) ..... 2002-383396

(51) Int. Cl.
*E04H 9/02* (2006.01)

(52) U.S. Cl. ..... 52/167.7; 52/167.1; 52/167.4

(58) Field of Classification Search ..... 52/34, 52/167.7, 167.4, 167.8, 167.1, 167.5; 384/44
See application file for complete search history.

(56) References Cited

U.S. PATENT DOCUMENTS 5,970,666 A * 10/1999 Kurabayashi et al. ..... 52/167.6
6,092,780 A * 7/2000 Kurabayashi et al. ..... 248/636
6,123,313 A * 9/2000 Otsuka et al. ..... 248/580
6,364,274 B1 * 4/2002 Omi et al. ..... 248/562

* cited by examiner

*Primary Examiner*—Basil Katcheves
(74) *Attorney, Agent, or Firm*—Burr & Brown

(57) ABSTRACT

Elastic support units are provided to at least one of upper and lower track rails of a seismic isolation guide. The elastic support units include two elastic supporters that are superposed one over the other in a vertical direction, Each elastic support unit includes an elastically deformable bed plate, two mutually parallel side portions, and side wall portions extending between each of the two parallel side portions and the bed plate raising a lower surface of the bed plate a prescribed height above lower surfaces of the side portions and creating a space between the side wall portions. The elastic supporters are arranged in a vertically opposite relation with respect to each other positioning the respective bed plates at vertically opposite ends with the respective side wall portions being disposed orthogonal to each other. The track rails are secured to the bed plates parallel to the side wall portions.

2 Claims, 11 Drawing Sheets

(A)

(B)

(A)

(B)

(A)

(B)

(C)

(A)

(B)

(A)

(B)

(C)

(A)

(B)

ELASTIC SUPPORTER, ELASTIC SUPPORT UNIT AND SEISMIC SUPPORT UNIT USING SAME

FIELD OF THE INVENTION

The present invention relates to an elastic supporter, an elastic support unit, and a seismic support unit suitable for seismic isolation guiding for relatively small-scale buildings with mounting surfaces of low accuracy for example.

DESCRIPTION OF THE RELATED ART

A first patent document: Japanese patent laid-open No. 2000-291653.

As a prior art seismic isolation guide, the applicant has already proposed a biaxial rolling guide apparatus as described in the above-mentioned first patent document.

The biaxial rolling guide apparatus in the form of the seismic isolation guide is installed between an upper structure of a building and a lower structure thereof including a foundation, in such a manner that it can support the upper structure for movements in all directions with respect to the lower structure so as to absorb the rolling of the building due to an earthquake thereby to prevent it from being transmitted to the upper structure.

That is, the apparatus is provided with two sets of upper and lower rolling guide parts each including a track rail and a movable block incorporating therein a plurality of rows of endlessly circulating rolling members which are in rolling contact with the track rail. The two sets of rolling guide parts are arranged in a vertically opposite relation with respect to each other so as to place the respective track rails at an upper end and a lower end, respectively. The respective track rails are arranged orthogonal to each other, and the movable blocks are integrally fixed to each other. The lower track rail is fixedly attached to the lower structure, and the upper track rail is fixedly attached to the upper structure.

However, with respect to vertical vibration or pitching, an impact is transmitted directly to the upper structure because of high rigidity of the guide apparatus. Therefore, in the above-mentioned first patent document, each track rail is provided with projected portions projecting to the left and right from a rail base portion. An impact or shock load, acting on the apparatus in a vertical direction, is absorbed by elastic deformations of the projected portions, so that the magnitude of the impact or shock load acting on rolling members can be reduced from three times the force of gravity (3G) to about two time the force of gravity (2G) for instance.

However, even if the impact is absorbed by the elastic deformations of the projected portions of the rails, there is a limit to the impact absorption due to the deformations of the projected portions.

Accordingly, the present invention has been made to solve the problems as referred to above, and is intended to provide an elastic supporter, an elastic support unit, and a seismic support unit using the same with a high vertical impact absorbing ability suitable for a seismic isolation guide.

SUMMARY OF THE INVENTION

In order to achieve the above object, an elastic supporter according to the present invention, which supports a seismic isolation guide provided with mutually orthogonal track rails, is characterized by comprising:

an elastically deformable bed plate having two mutually parallel sides; and side wall portions adapted to support the two parallel sides of said bed plate at a prescribed height, wherein a track rail of said seismic isolation guide is fixedly secured to said bed plate in parallel to said side wall portions.

It is further characterized in that said bed plate and said side wall portions are formed by bending a single piece of plate material.

In addition, it is characterized in that a fixed flange portion is provided at an end of each side wall portion opposite the bed plate.

An elastic support unit according to the present invention, which is constructed by two elastic supporters superposed one over the other in a vertical direction, is characterized in that said two elastic supporters are arranged in a vertically opposite relation with respect to each other in such a manner that said bed plates are positioned at vertically opposite ends with said side wall portions being disposed orthogonal to each other, and one track rail of said seismic isolation guide is fixedly secured to the bed plate of one of said elastic supporters in parallel to the side wall portions thereof, and the bed plate of the other elastic supporter has a central portion supported by a load support part, so that a vertical impact can be absorbed by the elastic deformations of the respective bed plates of said two elastic supporters.

A seismic support unit according to the present invention is characterized by comprising: a seismic isolation guide having two sets of upper and lower rolling guide parts each including a track rail and a movable block incorporating therein a plurality of rows of endlessly circulating rolling members which are in rolling contact with said track rail, said two sets of rolling guide parts being disposed in a vertically opposite relation with respect to each other in a manner such that said track rails are disposed at vertically opposite ends, respectively, said respective track rails being disposed orthogonal to each other with said respective movable blocks being integrally fixed to each other; and a pair of upper and lower elastic supporters to which said track rails of said seismic isolation guide are fixedly secured, respectively;

wherein each of said elastic supporters includes an elastically deformable bed plate having two mutually parallel sides, and side wall portions that support said two parallel sides of said bed plate at a prescribed height, said track rails being fixedly secured to said bed plates, respectively, in parallel to said side wall portions.

A seismic support unit according to the present invention is characterized by comprising: a seismic isolation guide having two sets of upper and lower rolling guide parts each including a track rail and a movable block incorporating therein a plurality of rows of endlessly circulating rolling members which are in rolling contact with said track rail, said two sets of rolling guide parts being disposed in a vertically opposite relation with respect to each other in a manner such that said track rails are disposed at vertically opposite ends, respectively, said respective track rails being disposed orthogonal to each other with said respective movable blocks being integrally fixed to each other; and an elastic support unit to which at least one of said upper and lower track rails of said seismic isolation guide is fixedly secured;

wherein said elastic support unit is constructed such that two elastic supporters, each of which includes an elastically deformable bed plate having two mutually parallel sides, and side wall portions that support said two parallel sides of said bed plate at a prescribed height, are superposed one over the other in a vertical direction, and said elastic supporters are disposed in a vertically opposite relation with respect to each other so that said bed plates are positioned at vertically opposite ends, respectively, with said respective side wall portions being disposed orthogonal to each other; and wherein the one track rail of said seismic isolation guide is fixedly secured to the bed plate of one of said elastic supporters in parallel to said side wall portions thereof, and the bed plate of the other elastic supporter has a central portion supported by a load support part, so that a vertical impact can be absorbed by the elastic deformations of the respective bed plates of said two elastic supporters.

BRIEF DESCRIPTION OF THE DRAWINGS

FIG. 4 shows a seismic isolation guide of FIG. 1, wherein FIG. 4(A) is a plan view, FIG. 4(B) is a front elevational view, and FIG. 4(C) is a side elevational view.

FIG. 5 shows an elastic support unit of the seismic support unit of FIG. 1, wherein FIG. 5(A) is a plan view, FIG. 5(B) is a front elevational view, and FIG. 5(C) is a side elevational view.

FIG. 6 shows a mounting plate of the seismic support unit of FIG. 1, wherein FIG. 6(A) is a plan view, FIG. 6(B) is a front elevational view, and FIG. 6(C) is a side elevational view.

FIG. 7 shows one example of a monoaxial rolling guide part constituting the seismic isolation guide of FIG. 4, wherein FIG. 7(A) is a front elevational view, FIG. 7(B) is a plan view, and FIG. 7(C) is a front elevational cross sectional view.

FIG. 9 shows an example of installation of seismic support units as shown in FIG. 1, wherein FIG. 9(A) is a front elevational view, and FIG. 9(B) is a plan view.

DESCRIPTION OF THE PREFERRED EMBODIMENTS

Now, preferred embodiments of the present invention will be described below in detail while referring to the accompanying drawings.

Embodiment 1

FIGS. 1 through 9 show an elastic supporter and a seismic support unit using the same according to a first embodiment of the present invention.

Figure 1:
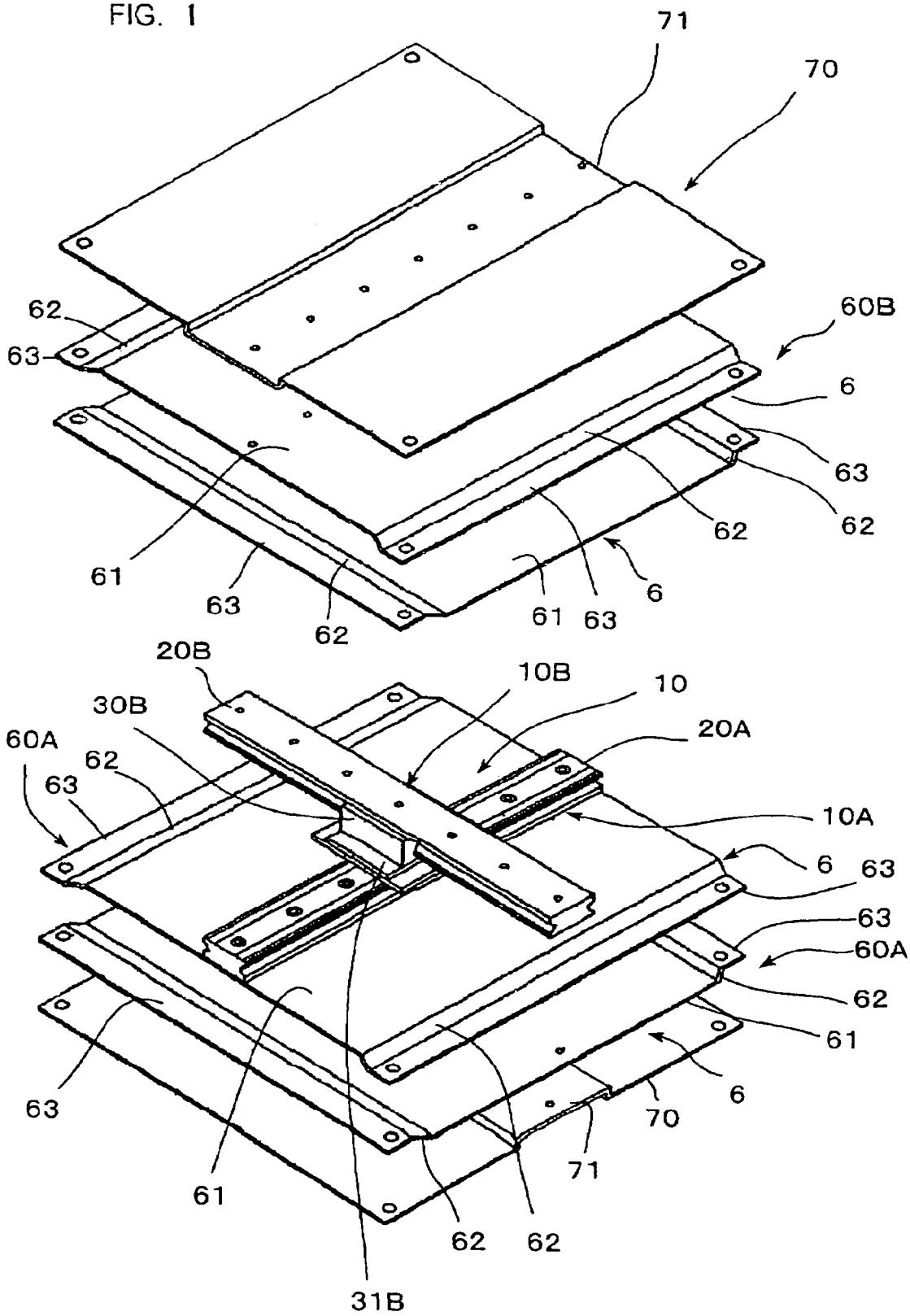
FIG. 1 is a schematic exploded perspective view of a seismic support unit according to a first embodiment of the present invention.
Figure 2:
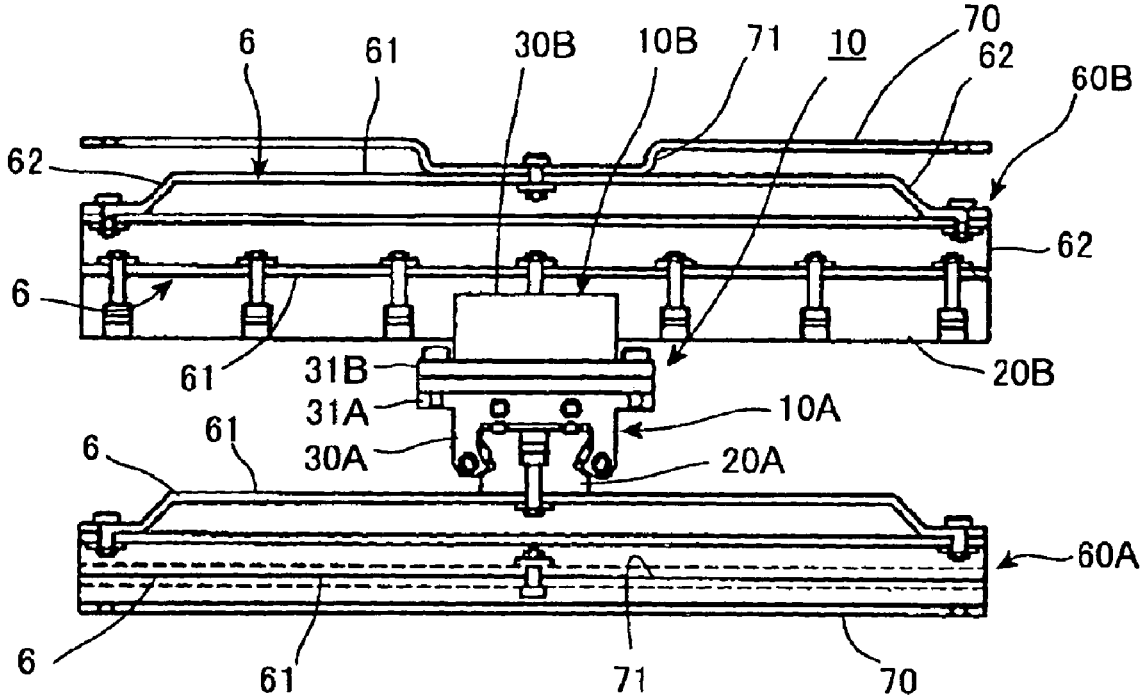
FIGS. 2(A) and 2(B) are a front elevational view and a side elevational view, respectively, showing the seismic support unit of FIG. 1 as being partially sectioned.
Figure 2:
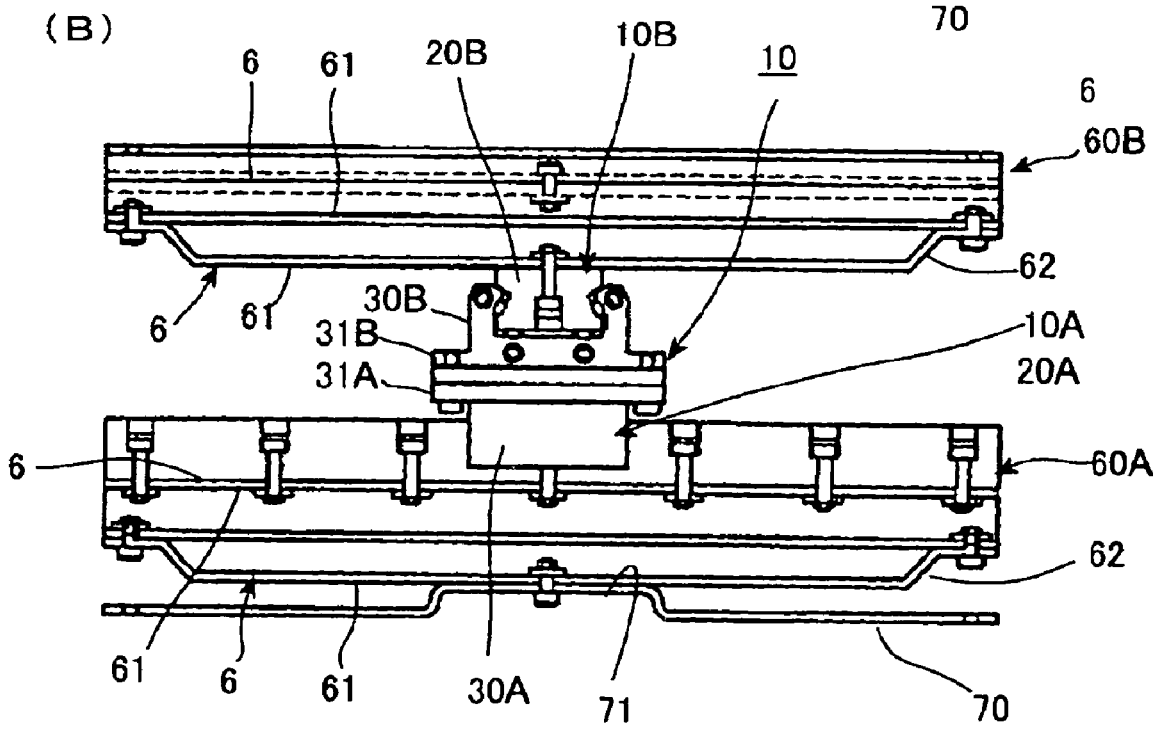
Figure 3:
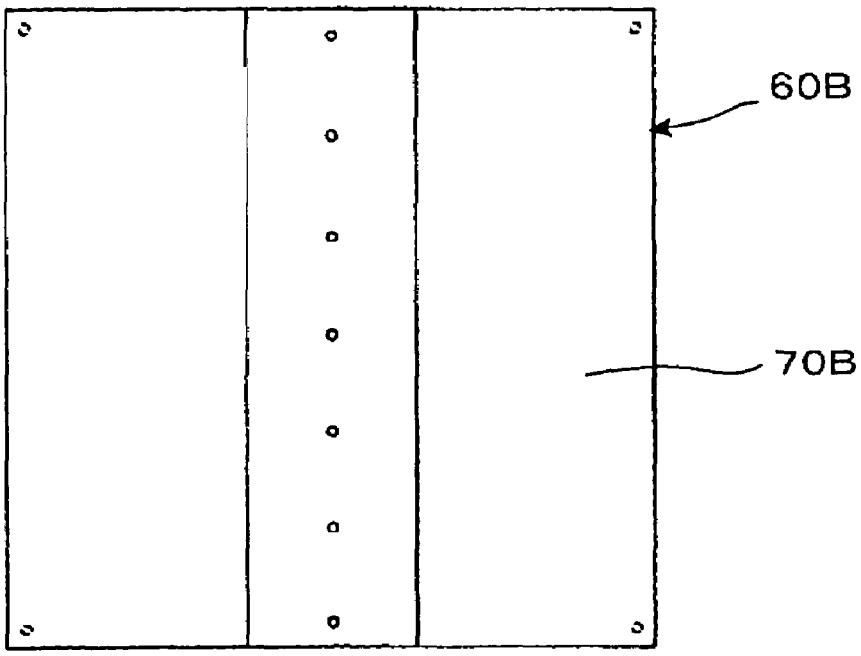
FIGS. 3(A) and 3(B) are a side elevational plan view and a bottom view, respectively, of the seismic support unit of FIG. 1.
Figure 3:
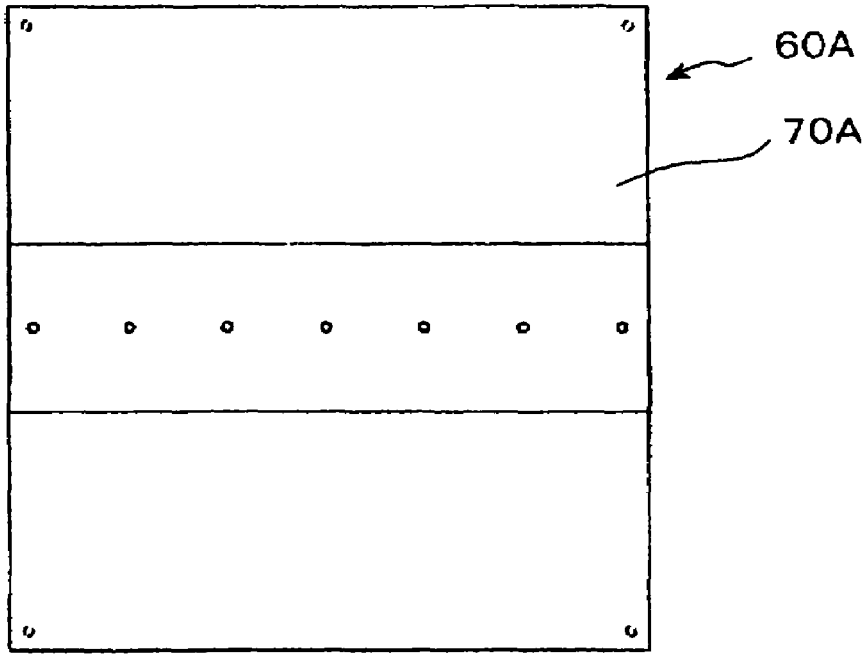

As shown in FIGS. 1 through 3, this seismic support unit 1 includes a seismic isolation guide 10 including mutually orthogonal track rails 20A, 20B and having degrees of freedom in two axial directions, and two elastic support units 60A, 60B to which both the upper and lower track rails 20A, 20B of this seismic isolation guide 10 are fixedly attached, respectively.

Figure 4:
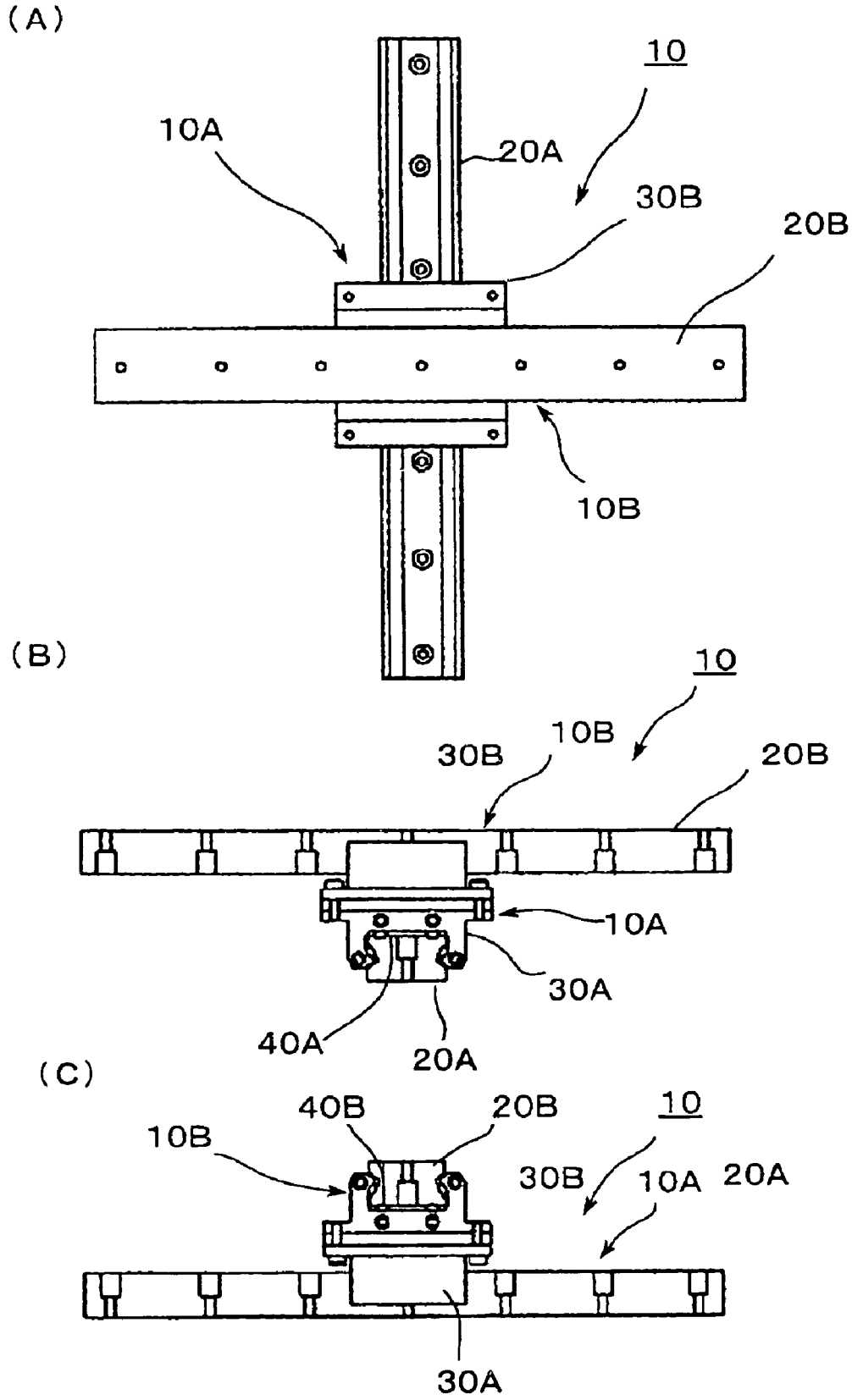
Figure 5:
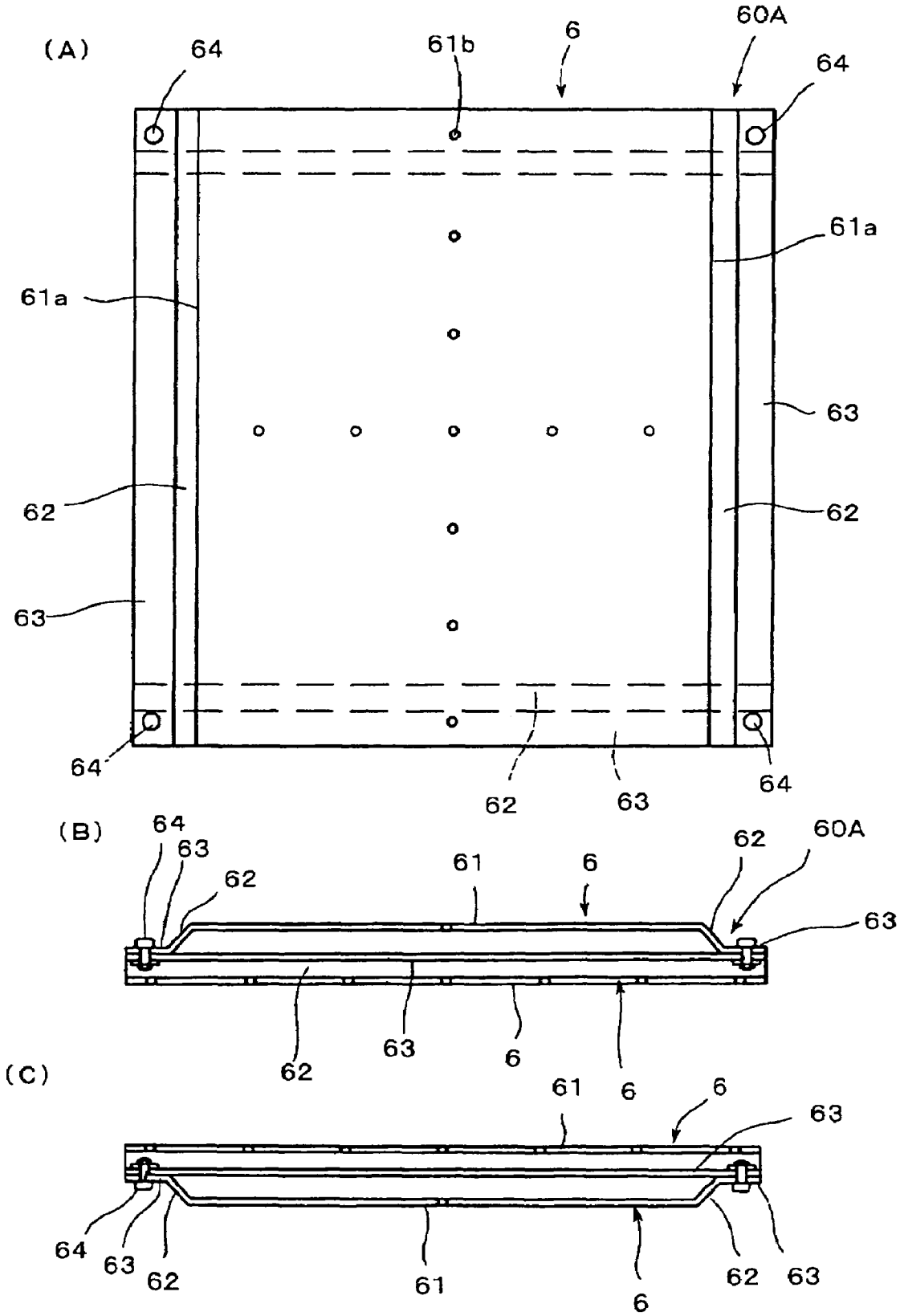
Figure 6:
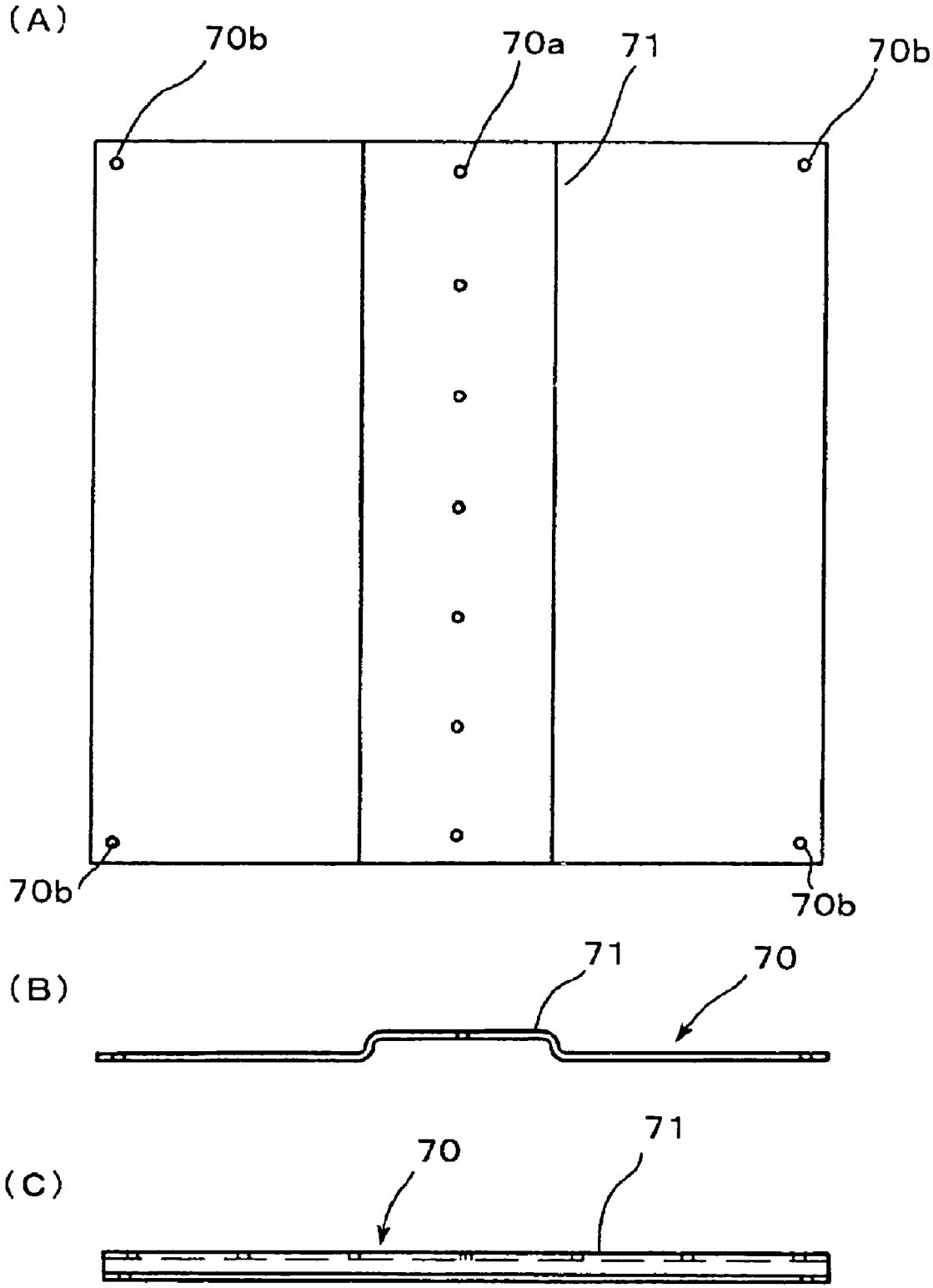

The seismic isolation guide 10 is constructed such that monoaxial rolling guide parts 10A, 10B arranged mutually orthogonal to each other are combined with each other in the vertical direction, as shown in FIG. 4. Each of the rolling guide parts 10A, 10B is of quite the same construction, and includes the track rails 20A, 20B, and movable blocks 30A, 30B incorporating therein a plurality of rows of endlessly circulating rolling members 40A, 40B which are in rolling contact with the track rails 20A, 20B, respectively. The respective track rails 20A, 20B are arranged at an upper end and a lower end in such a manner that they are directed in a vertically opposite and orthogonal relation with respect to each other. The respective movable blocks 30A, 30B are integrally fixed to each other in such a manner as to be movable in any direction. Among indexes or characters A, B attached to the reference numerals, "A" represents a lower structure whereas "B" represents an upper structure.

Here, note that the term "integration" includes the case in which the two separate movable blocks 30A, 30B are integrally coupled with each other by means of bolts or the like, and the case in which they are integrally molded with each other from a single seamless material. In this embodiment, the movable blocks 30A, 30B have flange portions, respectively, and are coupled with each other by means of bolts with the flange portions being overlapped one over the other. When the two movable blocks 30A, 30B are coupled with each other, more or less errors can be absorbed by the flexibility of the elastic support units 60A, 60B. As a result, such a high degree of precision as required in the prior art is not needed, and hence assembling of them can be facilitated. Accordingly, it is also possible to easily couple them with each other by electrodeposition welding or the like.

Figure 7:
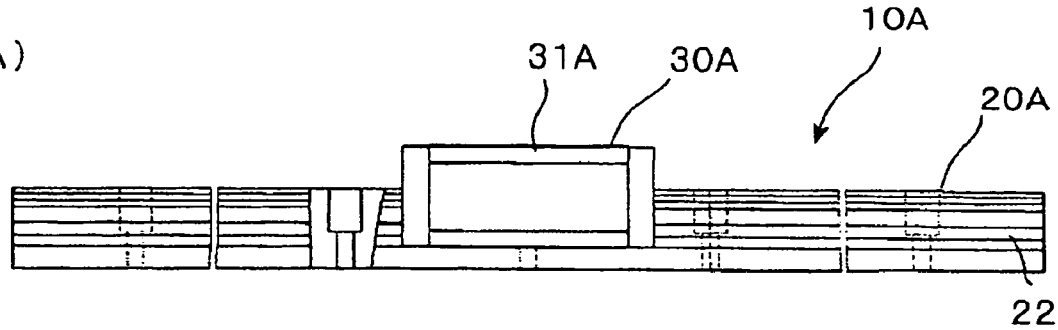
Figure 7:
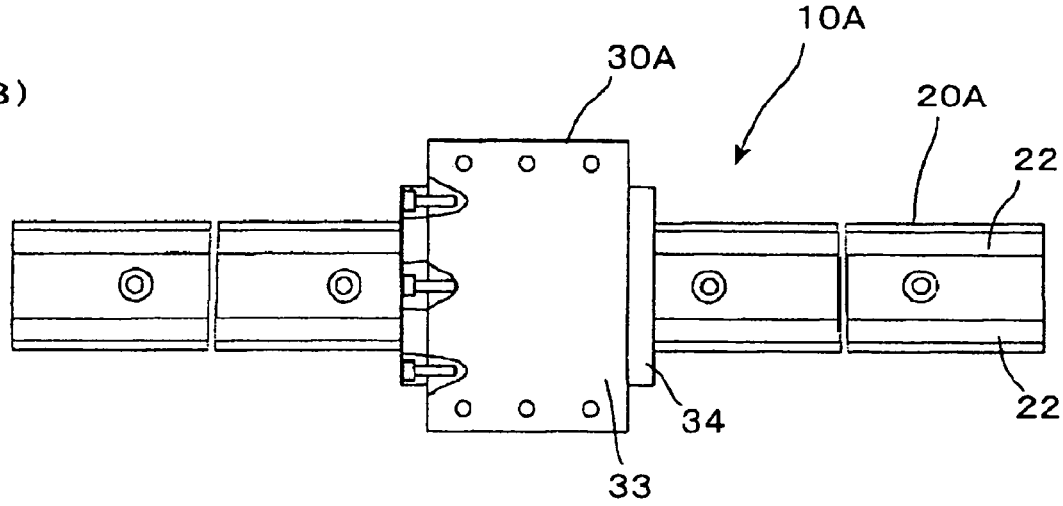
Figure 7:
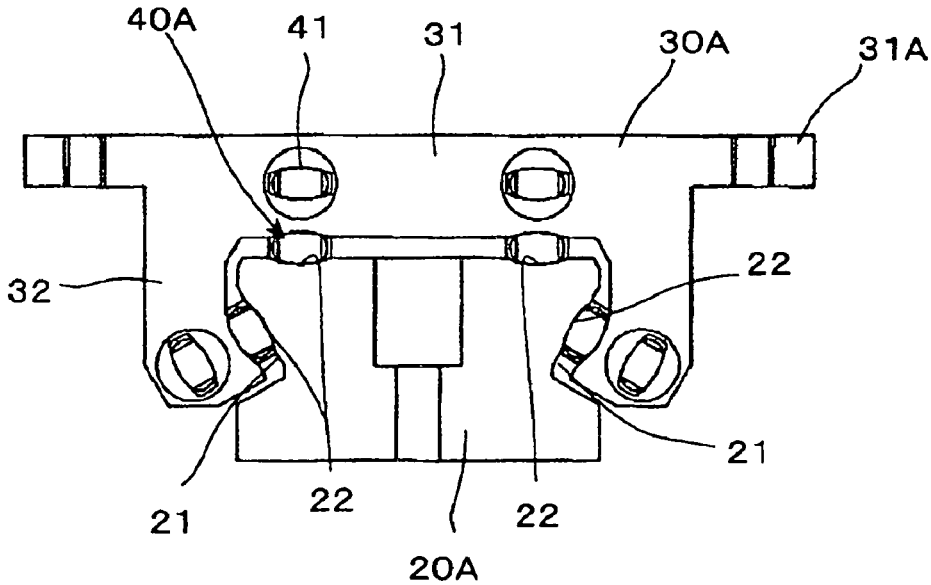
Figure 8:
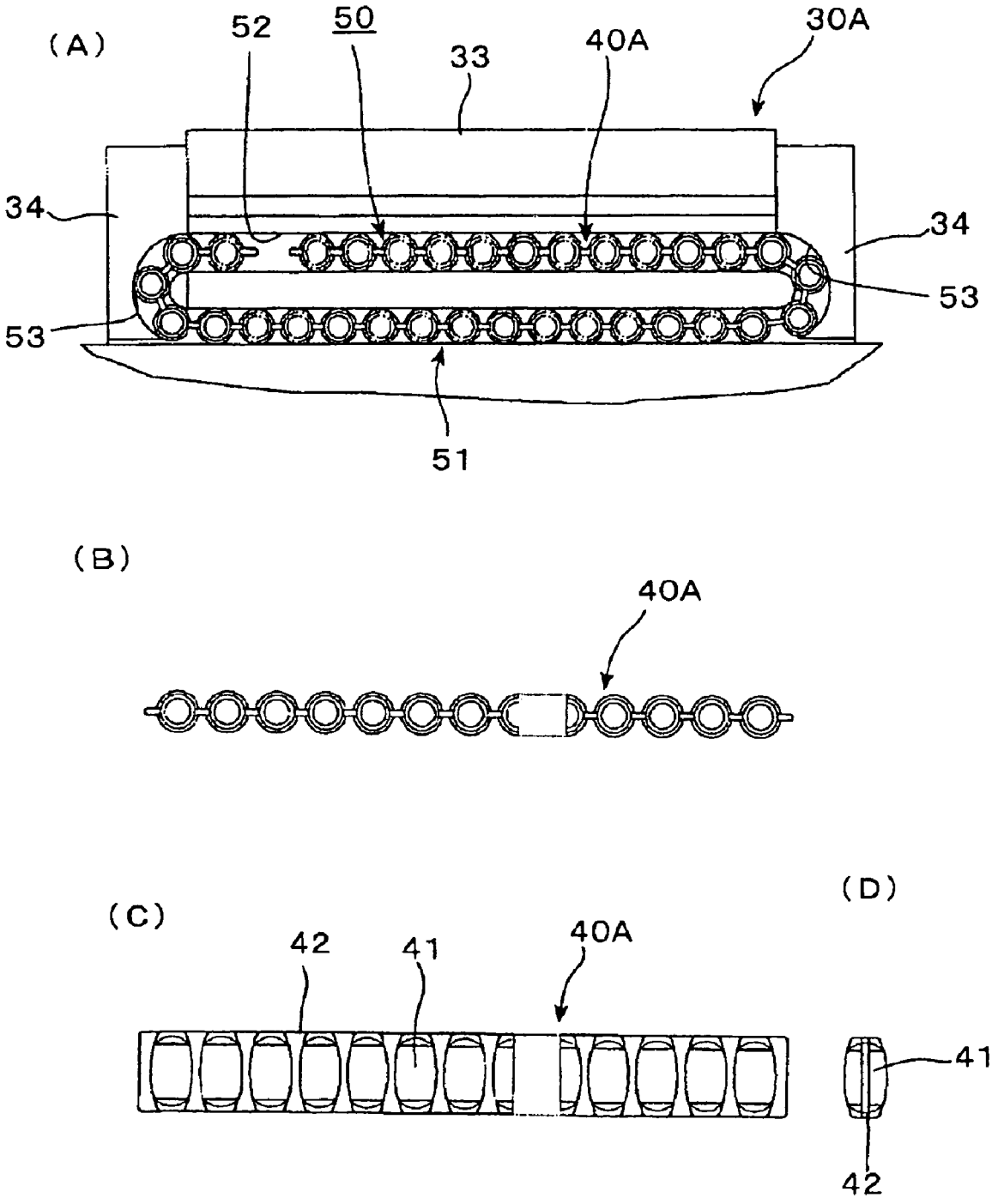
FIG. 8(A) is a cross sectional view of an endless circulation passage of the guide part of FIG. 7.
FIG. 8(B) is a partial front elevational view of a retainer for a row of rolling elements of FIG. 8(A)
FIG. 8(C) is a plan view of FIG. 8(B)
FIG. 8(D) is a side elevation of FIG. 8(B).

Now, reference will be made to the structure of each of the rolling guide parts 10A, 10B while referring to FIG. 7 and FIG. 8. The upper and lower rolling guide parts 10A, 10B are of quite the same construction, and hence only the lower rolling guide part 10A will be described below while omitting an explanation of the upper rolling guide part 10B.

The track rail 20A extends in a straight line, and has its upper surface formed as a flat plane, and its right and left side surfaces formed with inclined surfaces 21, respectively, each of which is inclined at an acute angle with respect to the upper surface. A total of four rows of track grooves 22 are arranged on the track rail in such a manner that two rows of track grooves are formed on the upper surface of the track rail and one row of track groove is formed on the inclined surface 21 of each of the right and left side surfaces.

The movable block 30A is provided with a horizontal portion 31 opposing the upper surface of the track rail 20A, and leg portions 32 depending or hanging down from the right and left opposite ends of the horizontal portion 31 so as to face the right and left side surfaces of the track rail 20A.

A total of four rows of endlessly circulating rolling members 40A are incorporated or built into the movable block 30A in correspondence to the track grooves 22 arranged on the track rail 20A in such a manner that two rows of rolling members are arranged in the horizontal portion 31 and one row of rolling members are arranged in each leg portion 32.

Barrel-shaped rollers 41 each having a rolling contact surface portion of a circular arc shape are used as the multitude of rolling members of the endlessly circulating rolling member rows 40A, and they are held by endless or non-endless flexible retainer members 42, and incorporated or built into a total of four endless circulation passages 50 at two locations in the horizontal portion 31 of the movable block 30A and at one location in each of the right and left leg portions 32. Of course, the rollers may be constructed such that they are not connected with one another through the retainer members 42. In addition, although the barrel-shaped rollers are used as the rolling elements, cylindrical rollers may instead be used.

The endless circulation passages 50 are each constructed of a rectilinear loaded-area passage 51 for supporting a load between the track rail 20A and the movable block 30A, an unloaded-area return passage 52 arranged at a predetermined distance from and in parallel to this loaded-area passage 51, and direction changing passages 53 for connecting the adjacent end portions of the loaded-area passage 51 and the return passage 52. The loaded-area passage 51 of each endless circulation passage 50 has a track groove 54 arranged in opposition to a corresponding track groove 22 on the track rail 20A with a row of rolling elements 40A being rollably clamped or sandwiched between these track grooves 22, 54. The direction changing passages 53 are constructed of end plates 34, 34 attached to the opposite ends of a block main body 33 of the movable block 30A.

Next, reference will be made to the upper and lower elastic support units 60A, 60B while referring to FIG. 1, FIG. 2, FIG. 5 and FIG. 6.

The upper and lower elastic support units 60A, 60B are of quite same construction except for a difference in the direction of arrangement, and hence only the lower elastic support unit 60A will be described herein while omitting an explanation of the upper elastic support unit 60B except for what is needed.

That is, the elastic support unit 60A is constructed such that elastic supporters 6, 6 of the same configuration are superposed one over the other in a vertically opposite and orthogonal relation with respect to each other.

Each elastic supporter 6 is constructed as including an elastically deformable rectangular-shaped bed plate 61 having two sides arranged in parallel to each other, side wall portions 62, 62 for supporting the two parallel sides of the bed plate 61 at a prescribed height, and fixed flange portions 63 each projecting horizontally from a side edge of each side wall portion 62 opposite or remote from the bed plate 61.

In this embodiment, each elastic supporter 6 is press molded by bending a single piece of plate material such as steel sheet or the like.

The elastic supporters 6, 6 are arranged in a vertically opposite relation with respect to each other so that the bed plates 61, 61 are positioned at vertically opposite ends with their side wall portions 62, 62 being disposed orthogonal to each other, and one track rail 20A of the seismic isolation guide 10 is fixedly secured to the bed plate 61 of one of the elastic supporters 6, 6 in parallel to the side wall portions 62 thereof, and the central portion of the bed plate 61 of the other elastic supporter 6 is supported by a seat 71 of a mounting plate 70 in the form of a load support part, whereby a vertical impact can be absorbed by the elastic deformations of the respective bed plates 61, 61 of the elastic supporters 6, 6. The lower mounting plate 70 is fixedly attached to a foundation of a building.

The above explanation is similarly applied to the upper support unit 60B, and another or upper mounting plate 70 for attachment to the upper structure of the building is fixedly secured to the bed plate 61 of the upper elastic supporter 6.

Each of the bed plates 61 is molded into a planar and substantially square configuration, and has bolt holes 61*b* formed therethrough at its central portion for fixing thereto the track rail 20A or the associated or upper mounting plate 70.

The side wall portions 62 of each bed plate 61 extend over the entire length thereof along the parallel sides 61*a*, 61*a* thereof, while being inclined at a prescribed angle so as to expand outwardly in the downward direction. The track rail 20A is fixedly secured to the center of the upper bed plate 61 of the lower elastic support unit 60A in parallel with respect to the side wall portions 62 thereof. Each side wall portion 62 is formed, at its end opposite or remote from the associated bed plate, with a fixed flange portion 63 projecting outwardly in a horizontal direction. The distance between the peripheral edges of the right and left fixed flange portions 63 is set equal to the length of the associated bed plate 61 and side wall portions 62, so that the entire planar shape becomes a square.

The fixed flange portions 63 are each in abutment at the longitudinal opposite ends thereof with the longitudinal opposite ends of the fixed flange portions 63 of the other elastic supporter 6 at four locations. These abutment portions are fixedly connected with each other by means of fastening members 64 such as bolts, but such connections may be carried out by welding instead of the fastening members.

The mounting plates 70 are also molded from steel sheet, and a fixed seat 71 of a prescribed height is formed at the center of each mounting plate 70 in a protruded manner. The central portion of a bed plate 61 is fixedly secured to the fixed seat 71 of an associated mounting plate 70. Each mounting plate 70 has bolt holes 70*a* formed therethrough in the center of its fixed seat 71 for attachment thereto of a bed plate 61 of an associated elastic supporter 6, and bolt holes 70*b* formed therethrough at its four corners for mounting thereof to the foundation. The width of each fixed seat 71 is greater than the width of each of the track rails 20A, 20B so as to provide stability.

Figure 9:
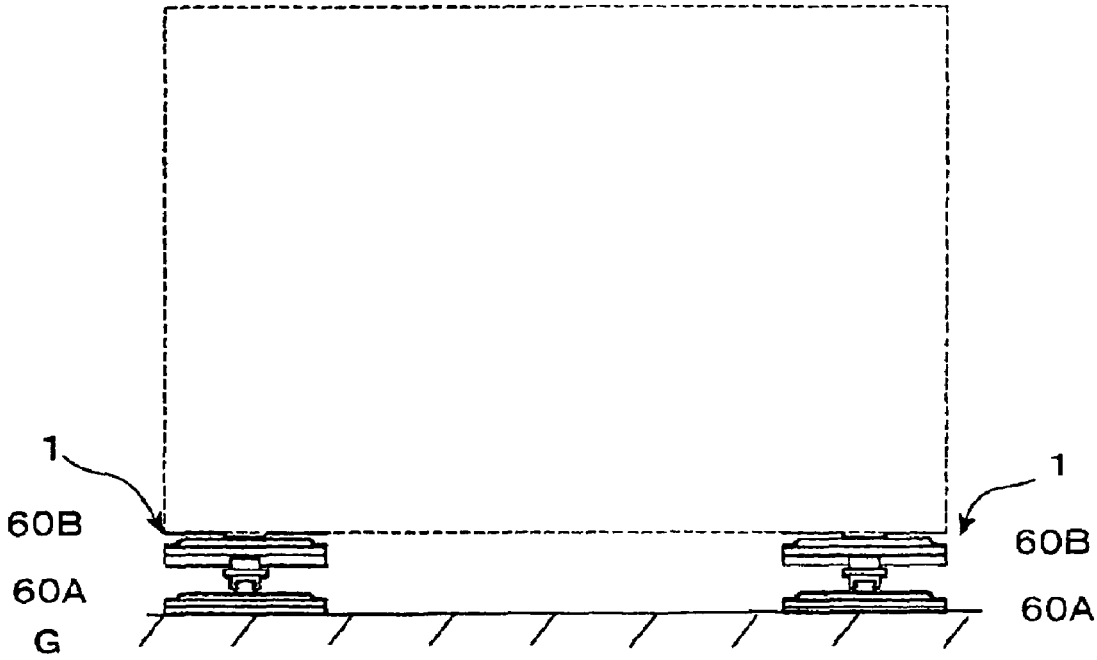
Figure 9:
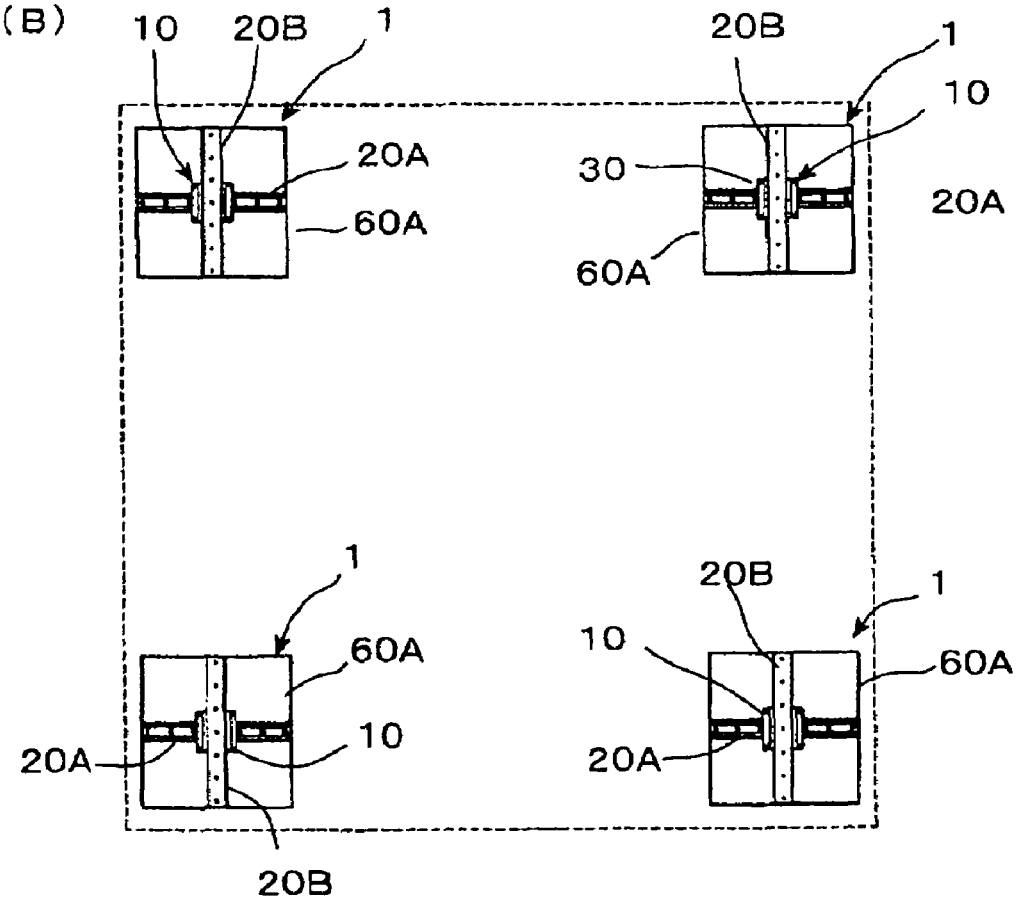

An example of installation of this seismic support unit is shown in FIG. 9.

That is, a plurality of seismic support units 1 are arranged on a foundation G of a building. Each lower elastic support unit 60A is fixedly attached to the foundation G by an associated mounting plate 70, and each upper elastic support unit 60B is fixedly attached to an upper structure C of the building through an associated mounting plate 70.

Each seismic support unit 1 of the present invention absorbs an impact load from above and a floating load from below through elastic deformations of the bed plates 61 of the elastic supporters 6 of the respective elastic support units 60A, 60B. For example, in cases where the elastic support units 60A, 60B are not attached or provided, all the impacts are transmitted to the rolling elements, but by the provision of the elastic support units 60A, 60B, it is possible to reduce or alleviate these impacts. Thus, if the impacts can be decreased to one-half for example, the rated load of the rolling members such as rollers can also be decreased to one-half, thereby making it possible to reduce the cost of manufacture.

For the vertical shock absorbing function, those mounting plates 70 of the elastic supporters 6 to which the track rails 20A, 20B of the elastic support units 60A, 60B are not fixed, i.e., those mounting plates 70 which are fixedly attached to the foundation G or the upper structure C of the building, have their fixed seats 71 protruded, so that the bed plates 61 can be deflected up to the height of protrusion of the fixed seats 71. Accordingly, by arranging the elastic support units 60A, 60B in the vertical direction one over the other, the respective bed plates 61 of the four elastic supporters 6, 6, 6 and 6 can be deflected in series to absorb the impacts. In particular, since the side wall portions 62, 62 supporting the bed plates 61 are arranged to open or expand at an obtuse angle with respect to the bed plates 61, they can be easily deflected.

Moreover, each pair of elastic supporters 6, 6, which constitute each of the elastic support units 60A, 60B, are assembled in an orthogonal relation with respect to each other. Therefore, a rail fixed portion of a bed plate 61 to which an associated track rail 20A is fixedly secured is tiltable in a direction to rotate about the central axis of the track rail 20A, so that it is elastically deformable in a direction to tilt or incline about an axis parallel to the side wall portions 62 which are in turn in parallel to the bed plate 61.

Further, the track rail fixed portion of the bed plate 61 of one elastic supporter 6 of each of the elastic support units 60A, 60B is tiltable about the central axis of an associated one of the track rails 20A, 20B, and the bed plate 61 of the other elastic supporter 6 is tiltable about an orthogonal axis (i.e., parallel to the other of the track rails 20B, 20A) orthogonal to that one of the track rails 20A, 20B with respect to the seat 71 of an associated mounting plate 70 in the form of a load support part. As a result, an inclination of the mounting surface of each of the track rails 20A, 20B in each seismic isolation guide 10 can be absorbed by the elastic deformation of each of the bed plates 6, 6. Accordingly, parallelism errors in all directions between the mounting surfaces at the foundation G side and at the building upper structure C side can be absorbed.

Particularly, by arranging a pair of elastic support units 60A, 60B above and below each seismic isolation guide 10, the absorption of the errors is shared by each pair of elastic support units 60A, 60B. As a consequence, the error absorption capability is increased.

Furthermore, the track rails 20A, 20B are fixedly secured to the bed plates 61, respectively, of the elastic supporters 6 in the upper and lower elastic support units 60A and 60B in parallel with respect to the side wall portions 62. Therefore, even if the bed plates 61 are caused to deflect in the vertical direction, the associated track rails 20A, 20B are displaced in parallel to the side wall portions 62 thereof while keeping their linearity. As a result, the track rails 20A, 20B are respectively kept straight, in other words, the track rails 20A, 20B are kept in an orthogonal state, so that the state of contact between the roller rows 40A, 40B between the track rails 20A, 20B and the movable blocks 30A, 30B and the track grooves is kept in an appropriate manner to permit the rollers to roll and move in a light and smooth manner, without impairing their rolling absorbing functions.

Still further, the elastic support units 60A, 60B and their associated seismic isolation guide 10 are integrally assembled with one another to form a unit. Thus, upon installation, it is only necessary to fixedly attach the mounting plates 70 alone, and hence any troublesome installation and adjustment of the track rails 20A, 20B are not required, thereby making it possible to reduce the time of installation to a substantial extent. Additionally, even if there are more or less errors of the mounting surfaces, it is possible to absorb these errors by the deflection of the bed plates 61 of the elastic support units 60A, 60B, thus making the handling thereof extremely easy.

Embodiment 2

Figure 10:
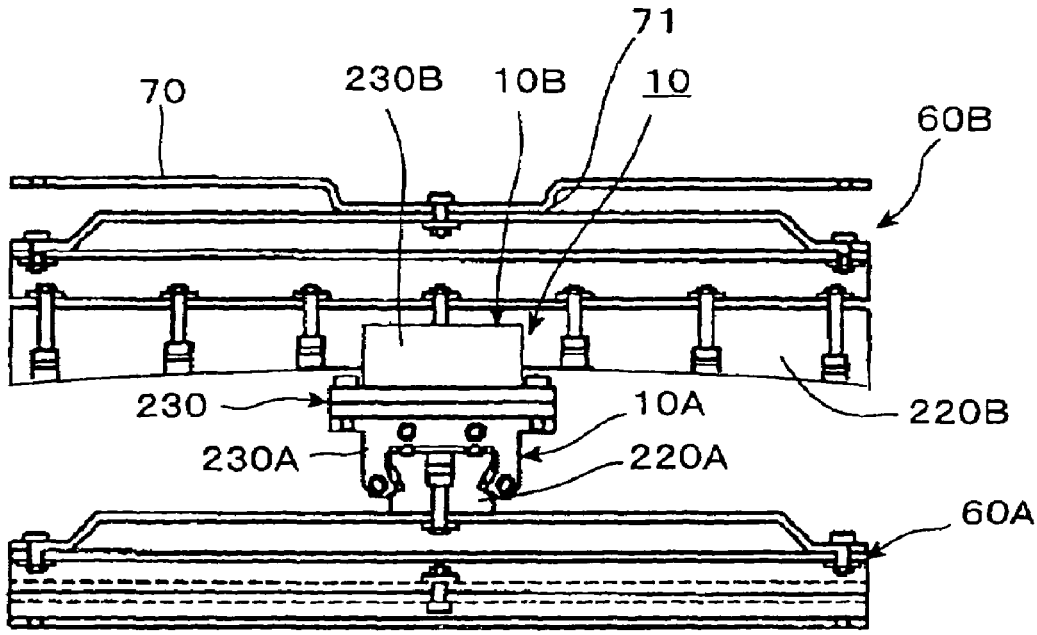
FIG. 10(A) is a front elevational view showing a seismic support unit as being partially sectioned according to a second embodiment of the present invention.
FIG. 10(B) is a front elevational view of a monodirectional curvilinear rolling guide part of the seismic support unit of FIG. 10(A)
FIG. 10(C) is a cross sectional view showing a roller circulation passage of FIG. 10(B).
Figure 10:
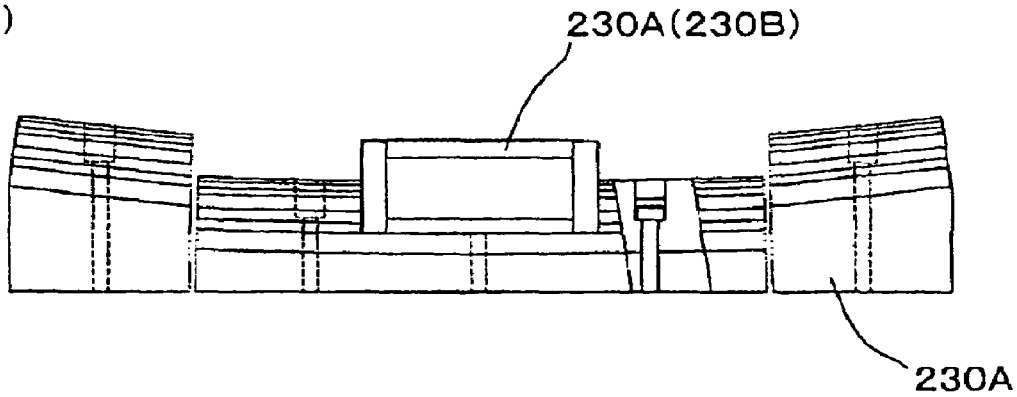
Figure 10:
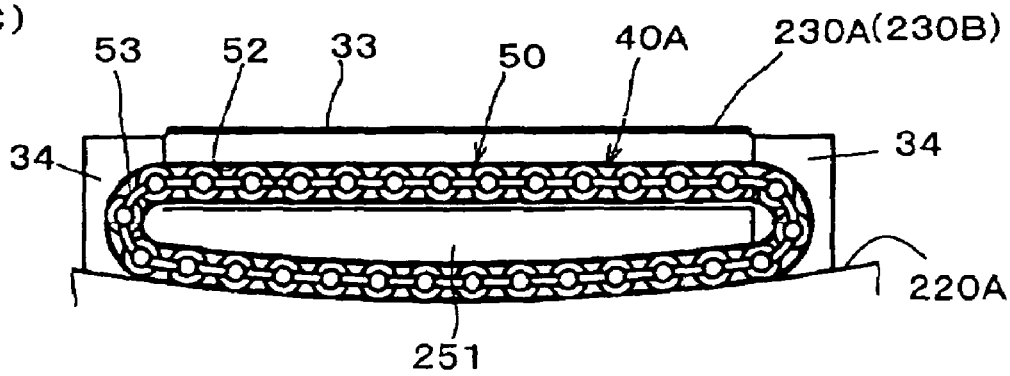
Figure 11:
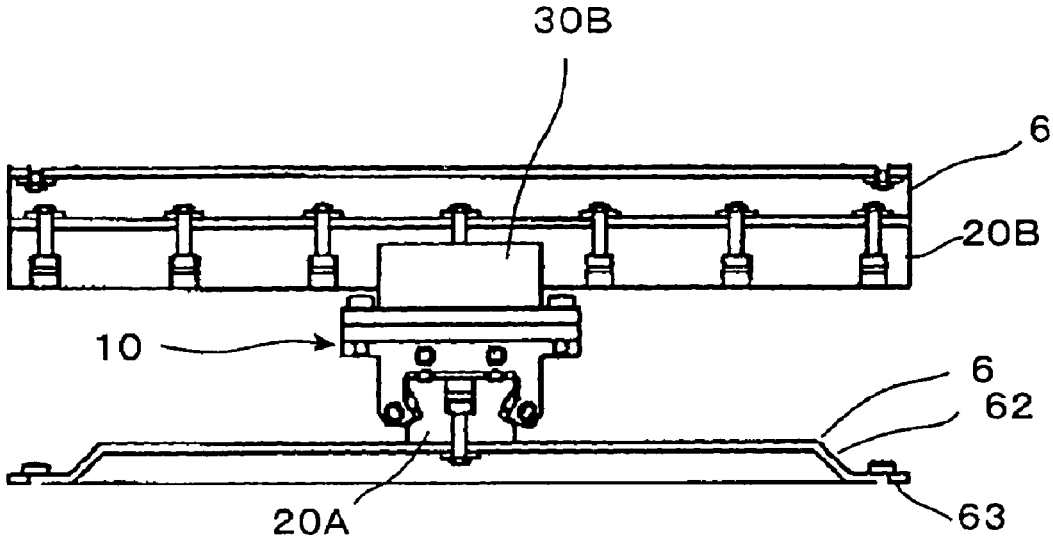
FIGS. 11(A) and 11(B) are a front elevational view and a side elevation view, respectively, of a seismic support unit as being partially sectioned according to a third embodiment of the present invention.
Figure 11:
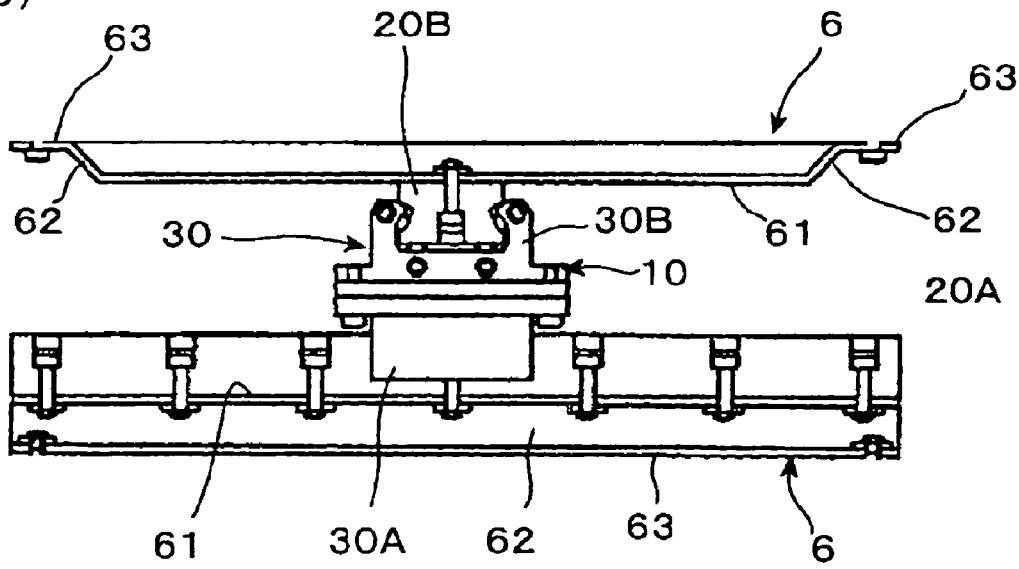

FIG. 10 shows a seismic support unit according to the second embodiment of the present invention. This second embodiment differs from the first embodiment in that each of track rails 220A, 220B comprises a curvilinear rail which curves in the vertical direction along the longitudinal direction thereof, but the construction of this second embodiment other than this is similar to that of the first embodiment. In the following description, differences alone will be explained with the same components being identified by the same symbols while omitting an explanation thereof.

A loaded rolling passage 251 of each circulation passage 50 in a movable block 230A (230B) is formed into a circular arc configuration in correspondence to the curvilinear configuration of the track rails 220A, 220B.

In this embodiment, a building is caused to move, under the action of seismic vibrational energy, in horizontal directions along the track rails 220A, 220B arranged vertically one over the other. However, since the respective track rails 220A, 220B are of vertically curved circular arc configuration, the building is lifted upwardly as it moves in the direction of vibration from its lowermost position, so that the kinetic energy of the building is converted into potential energy thereby to stop the upward movement of the building, and then the building is returned to its initial position under the action of gravity. After repeating such a pendulum motion several times, the building stops at the lowermost positions of the track rails 220A, 220B.

Since the track rails 220A, 220B are curved in the vertical direction, when the movable block 230A is moving along one track rail 220A, it will be tilted or inclined laterally or to the left or right with respect to the other track rail 220B. In the case of a prior art seismic isolation guide, it is necessary to interpose a universal joint between the upper and lower movable blocks 230B, 230A, but in the case of the present invention, such an inclination can be absorbed due to the flexibility of the elastic support units 60A, 60B. As a result, no universal joint is required. Though the curvature of the track rails 220A, 220B is described in an exaggerated manner in FIG. 10, the actual degree of curvature is small and hence can be dealt with in a satisfactory manner.

Embodiment 3

In a third embodiment of the present invention, a seismic isolation guide is not supported by the elastic support units constructed in combination of plural elastic supporters as in the first and second embodiments, but supported by single or non-combined elastic supporters 6 alone.

That is, provision is made for a pair of upper and lower elastic supporters 6, 6 to which track rails 20A, 20B of a seismic isolation guide 10 are fixedly secured, respectively. Each of the elastic supporters 6, 6 is constructed as including an elastically deformable rectangular-shaped bed plate 61 having two sides arranged in parallel to each other, and side wall portions 62, 62 for supporting the two parallel sides of the bed plate 61 at a prescribed height, with the track rails 20A, 20B being fixedly secured to the bed plates 61, 61, respectively, in parallel to the side wall portions 62, 62 thereof. The elastic support unit 60A or 60B of the first and second embodiments has only to support either one of the upper and lower parts of the seismic isolation guide 10, but in this third embodiment, the elastic supporters must be necessarily arranged above and below the seismic isolation guide.

As described in the foregoing, according to the invention as set forth in claim 1, with respect to impact loads acting thereon through track rails, it is possible to absorb the impacts by the elastic deformation of a bed plate of an elastic supporter.

In the case of provision of no elastic supporter, all the impacts are transmitted to rolling elements of a seismic isolation guide, but by the provision of the elastic supporter, it is possible to reduce or alleviate these impacts to a substantial extent. Thus, if the impacts can be decreased to one-half for example, the rated load of the rolling members of the seismic isolation guide can also be decreased to one-half, thereby serving for cost reduction.

In addition, since a track rail is fixedly arranged in parallel to side wall portions, even if the bed plate is deflected in the vertical direction, the track rail is merely displaced vertically in parallel to the side wall portions, so it is kept straight. Accordingly, rows of rolling elements between the track rail and a movable block are able to roll and move in a light and smooth manner.

Moreover, a track rail fixed portion of the bed plate is tiltable or inclinable about the central axis of an associated track rail due to the elastic deformation of the bed plate, so that it is possible to absorb mounting errors of the seismic isolation guide by the elastic deformation of the bed plate.

Further, if the bed plate and its side wall portions, which constitute the elastic supporter, are formed or molded by bending a single piece of plate material, as described in claim 2, formation or fabrication thereof is quite easy, and the cost of the fabrication thereof is low.

According to an elastic support unit as set forth in claim 3, respective bed plates of two elastic supporters are combined with each other in such a manner that they are arranged at vertically opposite ends in a vertically opposite relation with respect to each other with their side wall portions being disposed orthogonal to each other, and a track rail is fixedly secured to the bed plate of one of the elastic supporters, and a load support part is provided on the bed plate of the other elastic supporter, so that a vertical impact can be absorbed by the elastic deformations of the respective bed plates of the two elastic supporters. With such an arrangement, the impact load absorbing ability becomes twice as large as that of a single elastic supporter.

Further, a track rail fixed portion of the bed plate of one of elastic supporters is tiltable about the central axis of an associated one of track rails, and the bed plate of the one elastic supporter is tiltable about an orthogonal axis (i.e., parallel to the other track rail) orthogonal to the one track rail with respect to the load support part. Accordingly, an inclination of a mounting surface for each track rail of the seismic isolation guide can be absorbed by the elastic deformation of each bed plate.

According to a seismic support unit as set forth in claim 4, track rails of a seismic isolation guide are mounted to the above-mentioned elastic supporters, respectively. Thus, the elastic supporters have only to be fixedly attached to a building and a foundation of the building, thereby making the troublesome installation and adjustment of the track rails unnecessary to permit the time of installation to be shortened. In addition, even if there are more or less errors of mounting surfaces, it is possible to absorb these errors by the deflection of the bed plates of the elastic supporters, thus making the handling thereof extremely easy.

According to a seismic support unit as set forth in claim 5, in comparison with the seismic support unit as set forth in claim 4, it is only necessary to mount an elastic support unit to at least one of track rails of a seismic isolation guide.

Further, parallelism errors in all directions between the mounting surfaces at a foundation side and at a building upper structure side can be absorbed by deformations of the upper and lower bed plates of the single elastic support unit.

What is claimed is:

1. An elastic support unit for supporting a seismic isolation guide that is provided with mutually orthogonal track rails, said elastic support unit comprising two elastic supporters superposed in a vertical direction, each of the elastic supporters comprising:

an elastically deformable bed plate;

two mutually parallel side portions; and side wall portions extending between each of said two parallel side portions and said bed plate raising a lower surface of said bed plate a prescribed height above lower surfaces of said side portions and creating a space between said wall portions, wherein said two elastic supporters are arranged in a vertically opposite relation with respect to each other in such a manner that said bed plates are positioned at vertically opposite ends with said side wall portions being disposed orthogonal to each other, wherein one track rail of said seismic isolation guide is fixedly secured to the bed plate of one of said elastic supporters in parallel to the side wall portions thereof, wherein the bed plate of the other elastic supporter has a central portion supported by a load support part, and wherein vertical impacts are absorbed by the elastic deformations of the respective bed plates of said two elastic supporters.

2. A seismic support unit comprising:

a seismic isolation guide having upper and lower rolling guide parts each including a track rail and a movable block incorporating therein a plurality of rows of endlessly circulating rolling members which are in rolling contact with said track rail, said upper and lower rolling guide parts being disposed in a vertically opposite relation with respect to each other in a manner such that said track rails are disposed at vertically opposite ends, respectively, said respective track rails being disposed orthogonal to each other with said respective movable blocks being integrally fixed to each other; and an elastic support unit to which at least one of said upper and lower track rails of said seismic isolation guide is fixedly secured, wherein said elastic support unit is constructed such that two elastic supporters are superposed in a vertical direction, each of elastic supporters comprising:

an elastically deformable bed plate;

two mutually parallel side portion; and side wall portions extending between each of said two parallel side portions and said bed plate raising a lower surface of said bed plate a prescribed height above lower surface of said side portions and creating a space between said side wall portions, wherein said two elastic supporters are disposed in a vertically opposite relation with respect to each other so that said bed plates are positioned at vertically opposite ends, respectively, with said respective side wall portions being disposed orthogonal to each other, wherein the one track rail of said seismic isolation guide is fixedly secured to the bed plate of one of said elastic supporters in parallel to said side wall portions thereof, wherein the bed plate of the other elastic supporter has a central portion supported by a load support part, and wherein vertical impact are absorbed by the elastic deformations of the respective bed plates of said two elastic supporters.

* * * * *